US009090850B1

(12) United States Patent
Edwards et al.

(10) Patent No.: US 9,090,850 B1
(45) Date of Patent: Jul. 28, 2015

(54) PHOSPHORUS ANTI-WEAR COMPOUNDS FOR USE IN LUBRICANT COMPOSITIONS

(71) Applicants: David Ryan Edwards, Richmond, VA (US); Carey Garber Lehner, Richmond, VA (US)

(72) Inventors: David Ryan Edwards, Richmond, VA (US); Carey Garber Lehner, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/309,197

(22) Filed: Jun. 19, 2014

(51) Int. Cl.
*C10M 177/00* (2006.01)

(52) U.S. Cl.
CPC ..... *C10M 177/00* (2013.01)

(58) Field of Classification Search
None
See application file for complete search history.

(56) References Cited

U.S. PATENT DOCUMENTS 5,362,419 A 11/1994 Zinke et al.
5,922,657 A 7/1999 Camenzind et al.

OTHER PUBLICATIONS

Huanmou et al., "Lubricity of Carboxyl Acid Derivatives of O,O-dialkyl-phosphorodithioate," Journal of Hunan University, vol. 23, No. 3, 1996, pp. 65-70 (with English Translation).

*Primary Examiner* — Yong Chu
*Assistant Examiner* — Ana Z Muresan
(74) *Attorney, Agent, or Firm* — Clay Matthews; Fitch, Even, Tabin & Flannery LLP

(57) ABSTRACT

The present disclosure describes anti-wear compounds that improve the pack stability of a lubricant composition and are resistant to in situ degradation while maintaining effective anti-wear performance.

9 Claims, 1 Drawing Sheet

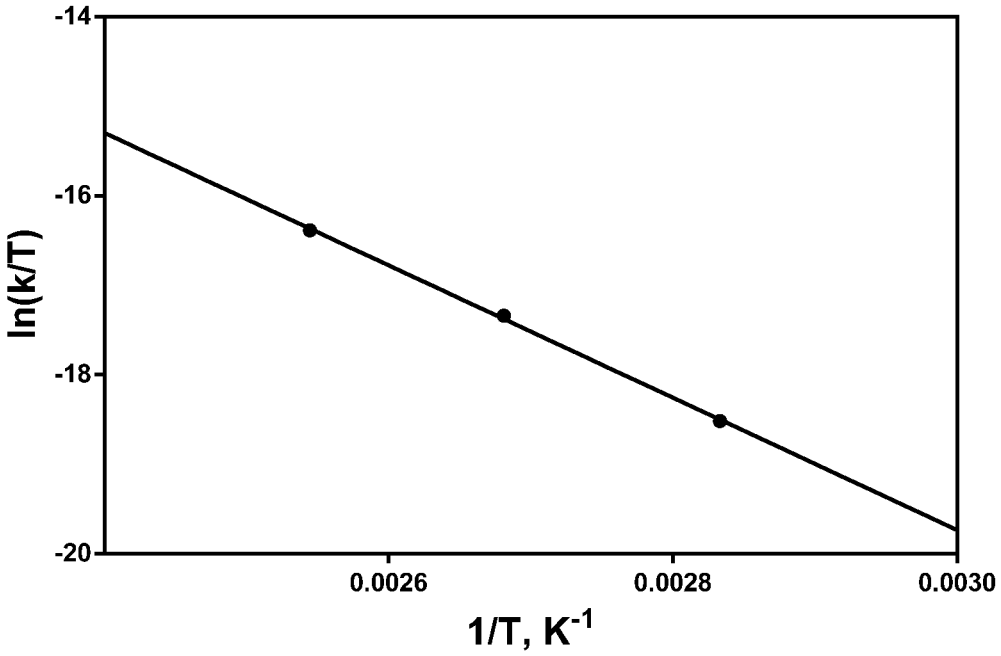
An Eyring plot of Comparative Example I providing an $r^2 = 0.999$.

PHOSPHORUS ANTI-WEAR COMPOUNDS FOR USE IN LUBRICANT COMPOSITIONS

FIELD

This disclosure relates to novel highly stable anti-wear lubricant additives that may be used to increase the pack stability of a lubricating fluid while protecting against wear and corrosion.

BACKGROUND

Lubricating compositions are used to prevent damage to machinery under operating conditions. Typically, modern lubricants contain additives that perform a variety of protective functions. Example additives include antioxidants, extreme pressure agents and anti-wear agents. Dithiophosphate derivatives in particular have been used as anti-wear agents to protect metal parts under boundary lubricating conditions thereby minimizing harmful metal-to-metal contact.

In practice, lubricants are frequently transported long distances over a period of days, sometimes weeks. Furthermore, lubricant products may sit in various storage facilities prior to being made available for purchase to the end user. Due to the complex chemical nature of lubricant compositions certain in situ reactions may take place during the transport or storage period of a lubricant. Lubricant compositions utilizing dithiophosphate components in particular are susceptible to in situ reactions thereby creating "off spec" lubricants, that is, lubricant compositions that do not meet the manufacturer's lubricant performance specifications. Using "off spec" lubricants creates uncertainty in the effectiveness of a lubricant and in some cases actual damage may occur to the machines in which these lubricants are used. For example, anti-wear components that decompose in situ may lose their effectiveness and increase the wear of metal parts. Accordingly, there has been a long felt need to have more stable dithiophosphate anti-wear chemistry, and in particular dithiophosphate chemistry that is resistant to in situ degradation while maintaining the required level of anti-wear performance.

A class of dithiophosphate anti-wear compounds was previously disclosed in U.S. Pat. No. 5,922,657. Other dithiophosphate anti-wear compounds have been described in U.S. Pat. No. 5,362,419. Finally, some lubricating properties of O,O-dialkyl-phosphorodithioates have been described by Huanmou et al. (Journal of Hunan University, vol. 23, no. 3, 1996, pp. 65-70). However, none of these anti-wear agents addresses the stability issues previously identified for this class of compounds.

It has now been discovered that certain novel compounds as described hereinbelow, having unique alkyl substitution on the dithiophosphate, have highly desirable stability properties, making the compounds resistant to in situ degradation, and may be readily formulated into lubricating compositions to provide excellent wear performance.

BRIEF SUMMARY OF THE INVENTION

The present disclosure describes anti-wear compounds that improve the pack stability of a lubricant composition and are resistant to in situ degradation while maintaining effective anti-wear performance.

In one embodiment the present invention includes a compound of Formula I:

Formula I

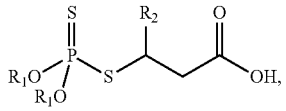

or a tribologically acceptable salt, solvate, hydrate, or proadditive thereof, wherein $R_1$ is $C_{4-9}$ alkyl or $C_{4-9}$ cycloalkyl; and wherein $R_2$ is a $C_{1-3}$ alkyl. It was unexpectedly discovered that alkyl substitution at the position corresponding to R2 in Formula I led to a dramatic improvement in the stability (as measured by the Pack Stability) of Formula I type dithiophosphate compounds. At the same time, this increased stability of the compounds of Formula I did not reduce the wear characteristics.

In another embodiment the compound of Formula 1 has $R_2$ as methyl.

In yet another embodiment the compound of Formula I has $R_1$ as a $C_{4-5}$ alkyl.

For example, the compound of Formula I may have $R_1$ as a $C_{4-5}$ alkyl and $R_2$ as methyl.

In still another embodiment the compound of Formula I is selected from the group consisting of: 3-((diisobutoxyphosphorothioyl)thio)butanoic acid; 3-((diisobutoxyphosphorothioyl)thio)pentanoic acid; 3-((dibutoxyphosphorothioyl)thio)butanoic acid; 3-((dibutoxyphosphorothioyl)thio)pentanoic acid; 3-((bis(pentyloxy)phosphorothioyl)thio)butanoic acid; 3-((bis(pentyloxy)phosphorothioyl)thio)pentanoic acid; 3-((bis(hexyloxy)phosphorothioyl)thio)butanoic acid; 3-((bis(hexyloxy)phosphorothioyl)thio)pentanoic acid; 3-((bis(heptyloxy)phosphorothioyl)thio)butanoic acid; 3-((bis(heptyloxy)phosphorothioyl)thio)pentanoic acid; 3-((bis(octyloxy)phosphorothioyl)thio)butanoic acid; 3-((bis(octyloxy)phosphorothioyl)thio)pentanoic acid; 3-((bis(nonyloxy)phosphorothioyl)thio)butanoic acid; 3-((bis(nonyloxy)phosphorothioyl)thio)pentanoic acid; 3-((bis((2-methylpentyl)oxy)phosphorothioyl)thio)butanoic acid; 3-((bis((2-methylpentyl)oxy)phosphorothioyl)thio)pentanoic acid; 3-((bis((4-methylpentan-2-yl)oxy)phosphorothioyl)thio)butanoic acid; and 3-((bis((4-methylpentan-2-yl)oxy)phosphorothioyl)thio)pentanoic acid or a tribologically acceptable salt, solvate, hydrate, or proadditive thereof.

In another embodiment the compound of Formula I is: 3-((diisobutoxyphosphorothioyl)thio)butanoic acid, having a Formula II:

Formula II

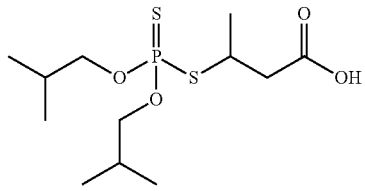

or a tribologically acceptable salt, solvate, hydrate, or proadditive thereof.

In one embodiment, the invention is a lubricant composition comprising: a) a majority base oil; and b) at least one compound of Formula I:

Formula I

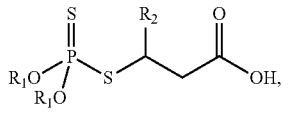

or a tribologically acceptable salt, solvate, hydrate, or proadditive thereof, wherein $R_1$ is $C_{4-9}$ alkyl or $C_{4-9}$ cycloalkyl; and wherein $R_2$ is a $C_{1-3}$ alkyl.

In another embodiment the lubricant composition having the at least one compound of Formula I, the compound of Formula I has a methyl as $R_2$.

In another embodiment the lubricant composition having the at least one compound of Formula I, the compound of Formula I has a $C_{4-5}$ alkyl as $R_1$.

For example, the compound of Formula I may have $R_1$ as a $C_{4-5}$ alkyl and $R_2$ as methyl.

In another embodiment the lubricant composition having the at least one compound of Formula I, the compound of Formula I is selected from the group consisting of: 3-((diisobutoxyphosphorothioyl)thio)butanoic acid; 3-((diisobutoxyphosphorothioyl)thio)pentanoic acid; 3-((dibutoxyphosphorothioyl)thio)butanoic acid; 3-((dibutoxyphosphorothioyl)thio)pentanoic acid; 3-((bis(pentyloxy)phosphorothioyl)thio)butanoic acid; 3-((bis(pentyloxy)phosphorothioyl)thio)pentanoic acid; 3-((bis(hexyloxy)phosphorothioyl)thio)butanoic acid; 3-((bis(hexyloxy)phosphorothioyl)thio)pentanoic acid; 3-((bis(heptyloxy)phosphorothioyl)thio)butanoic acid; 3-((bis(heptyloxy)phosphorothioyl)thio)pentanoic acid; 3-((bis(octyloxy)phosphorothioyl)thio)butanoic acid; 3-((bis(octyloxy)phosphorothioyl)thio)pentanoic acid; 3-((bis(nonyloxy)phosphorothioyl)thio)butanoic acid; 3-((bis(nonyloxy)phosphorothioyl)thio)pentanoic acid; 3-((bis((2-methylpentyl)oxy)phosphorothioyl)thio)butanoic acid; 3-((bis((2-methylpentyl)oxy)phosphorothioyl)thio)pentanoic acid; 3-((bis((4-methylpentan-2-yl)oxy)phosphorothioyl)thio)butanoic acid; and 3-((bis((4-methylpentan-2-yl)oxy)phosphorothioyl)thio)pentanoic acid or a tribologically acceptable salt, solvate, hydrate, or proadditive thereof.

In another embodiment the lubricant composition having the at least one compound of Formula I, the compound of Formula I is: 3-((diisobutoxyphosphorothioyl)thio)butanoic acid, having a Formula II Formula II

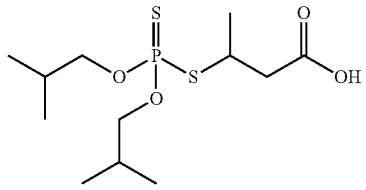

or a tribologically acceptable salt, solvate, hydrate, or proadditive thereof.

In another embodiment the lubricant composition of the present invention further comprises an oil-soluble ashless dispersant selected from the group consisting of: a succinimide dispersant, a succinic ester dispersant, a succininic ester-amide dispersant, a Mannich base dispersant, phosphorylated forms thereof, and boronated forms thereof.

In still another embodiment the lubricant composition of the present invention further comprises an additive composition comprising at least one component selected from the group consisting of an air expulsion additive, an antioxidant, a corrosion inhibitor, a foam inhibitor, a metallic detergent, a seal-swell agent, a viscosity index improver, and an extreme pressure additive.

In one embodiment the lubricant composition of the present invention includes the at least one compound of Formula I present in an amount in the range of from about 0.010 to about 4 wt % based on the weight of the lubricant composition.

In another embodiment the lubricant composition of the present invention includes the at least one compound of Formula I present in an amount in the range of from about 0.015 to about 1.0 wt % based on the weight of the lubricant composition.

In yet another embodiment the lubricant composition of the present invention includes the at least one compound of Formula I present in an amount in the range of from about 0.015 to about 0.5 wt % based on the weight of the lubricant composition.

The compound of the invention according to Formula I defined above and the lubricating composition of the present invention may be used for lubricating a machine part. They may in addition or in the alternative, be used for improving the pack stability of a lubricant composition.

In one embodiment the present invention is a method of lubricating a machine part comprising lubricating the machine part with a lubricant composition comprising: a) a majority base oil; and b) at least one compound of Formula I:

Formula I

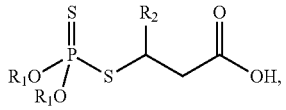

or a tribologically acceptable salt, solvate, hydrate, or proadditive thereof, wherein $R_1$ is $C_{4-9}$ alkyl or $C_{4-9}$ cycloalkyl; and wherein $R_2$ is a $C_{1-3}$ alkyl.

In another embodiment the method of the present invention includes a method of lubricating a machine part wherein the at least one compound of Formula I has an $R_2$ which is a methyl group.

In another embodiment the method of the present invention includes a method of lubricating a machine part wherein the at least one compound of Formula I has a $C_{4-5}$ alkyl as $R_1$.

For example, the compound of Formula I may have $R_1$ as a $C_{4-5}$ alkyl and $R_2$ as methyl.

In another embodiment the method of the present invention includes a method of lubricating a machine part wherein the at least one compound of Formula I is selected from the group consisting of: 3-((diisobutoxyphosphorothioyl)thio)butanoic acid; 3-((diisobutoxyphosphorothioyl)thio)pentanoic acid; 3-((dibutoxyphosphorothioyl)thio)butanoic acid; 3-((dibutoxyphosphorothioyl)thio)pentanoic acid; 3-((bis(pentyloxy)phosphorothioyl)thio)butanoic acid; 3-((bis(pentyloxy)phosphorothioyl)thio)pentanoic acid; 3-((bis(hexyloxy)phosphorothioyl)thio)butanoic acid; 3-((bis(hexyloxy)phosphorothioyl)thio)pentanoic acid; 3-((bis(heptyloxy)phosphorothioyl)thio)butanoic acid; 3-((bis(heptyloxy)

phosphorothioyl)thio)pentanoic acid; 3-((bis(octyloxy) phosphorothioyl)thio)butanoic acid; 3-((bis(octyloxy) phosphorothioyl)thio)pentanoic acid; 3-((bis(nonyloxy) phosphorothioyl)thio)butanoic acid; 3-((bis(nonyloxy) phosphorothioyl)thio)pentanoic acid; 3-((bis((2-methylpentyl)oxy)phosphorothioyl)thio)butanoic acid; 3-((bis((2-methylpentyl)oxy)phosphorothioyl)thio)pentanoic acid; 3-((bis((4-methylpentan-2-yl)oxy)phosphorothioyl)thio)butanoic acid; and 3-((bis((4-methylpentan-2-yl)oxy)phosphorothioyl)thio)pentanoic acid or a tribologically acceptable salt, solvate, hydrate, or proadditive thereof.

In another embodiment the method of the present invention includes a method of lubricating a machine part wherein the at least one compound of Formula I is: 3-((diisobutoxyphosphorothioyl)thio)butanoic acid, having a Formula II Formula II

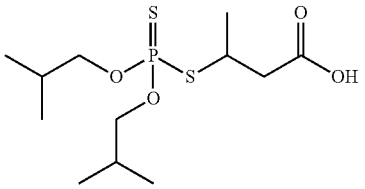

or a tribologically acceptable salt, solvate, hydrate, or proadditive thereof.

In another embodiment the method of the present invention includes a method of lubricating a machine part wherein the at least one compound of Formula I as defined above is present in an amount in the range from about 0.010 to about 4 wt % or from about 0.015 to about 1.0 wt % or from about 0.015 to about 0.5 wt % based on the weight of the lubricant composition.

In another embodiment the present invention includes a method of lubricating a machine part wherein the machine part comprises a gear, an axle, a differential, an engine, a crankshaft, a transmission, a clutch, a hydraulic apparatus, a slideway apparatus, and a turbine.

In another embodiment the method of the present invention includes a method of lubricating a transmission wherein said transmission is selected from the group consisting of an automatic transmission, a manual transmission, an automated manual transmission, a semi-automatic transmission, a dual clutch transmission, a continuously variable transmission, and a toroidal transmission.

In another embodiment the method of the present invention includes a method of lubricating a transmission wherein said transmission comprises a continuously slipping torque converter clutch, a slipping torque converter, a lock-up torque converter, a starting clutch, one or more shifting clutches, or an electronically controlled converter clutch.

In another embodiment the method of the present invention includes a method of lubricating a gear wherein said gear is selected from the group consisting of an automotive gear, a stationary gearbox, and an axle.

In another embodiment the method of the present invention includes a method of lubricating a gear wherein said gear is selected from the group consisting of a hypoid gear, a spur gear, a helical gear, a bevel gear, a worm gear, a rack and pinion gear, a planetary gear set, and an involute gear.

In another embodiment the method of the present invention includes a method of lubricating a differential wherein said differential is selected from the group consisting of a straight differential, a turning differential, a limited slip differential, a clutch-type limited slip differential, and a locking differential.

In another embodiment the method of the present invention includes a method of lubricating an engine wherein said engine is selected from the group consisting of an internal combustion engine, a rotary engine, a gas turbine engine, a four-stroke engine, and a two-stroke engine.

In another embodiment the method of the present invention includes a method of lubricating an engine wherein said engine comprises a piston, a bearing, a crankshaft, and/or a camshaft.

In yet another embodiment the present invention includes a method for improving the pack stability of a lubricant composition comprising including in a lubricating fluid an effective amount of one or more compounds of Formula I:

Formula I

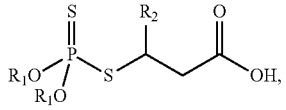

or a tribologically acceptable salt, solvate, hydrate, or proadditive thereof, wherein $R_1$ is $C_{4-9}$ alkyl or $C_{4-9}$ cycloalkyl; and wherein $R_2$ is a $C_{1-3}$ alkyl.

In still another embodiment the method of the present invention for improving the pack stability of a lubricant composition includes using a lubricating fluid having an effective amount of Formula I wherein the at least one compound of Formula I has a methyl as $R_2$.

In still another embodiment the method of the present invention for improving the pack stability of a lubricant composition includes using a lubricating fluid having an effective amount of Formula I wherein the at least one compound of Formula I has a $C_{4-5}$ alkyl as $R_1$.

For example, the compound of Formula I may have $R_1$ as a $C_{4-5}$ alkyl and $R_2$ as methyl.

In yet another embodiment the method of the present invention for improving the pack stability of a lubricant composition includes using a lubricating fluid having an effective amount of Formula I wherein the at least one compound of Formula I is selected from the group consisting of: 3-((diisobutoxyphosphorothioyl)thio)butanoic acid; 3-((diisobutoxyphosphorothioyl)thio)pentanoic acid; 3-((dibutoxyphosphorothioyl)thio)butanoic acid; 3-((dibutoxyphosphorothioyl)thio)pentanoic acid; 3-((bis(pentyloxy)phosphorothioyl)thio)butanoic acid; 3-((bis(pentyloxy)phosphorothioyl)thio)pentanoic acid; 3-((bis(hexyloxy)phosphorothioyl)thio)butanoic acid; 3-((bis(hexyloxy) phosphorothioyl)thio)pentanoic acid; 3-((bis(heptyloxy) phosphorothioyl)thio)butanoic acid; 3-((bis(heptyloxy) phosphorothioyl)thio)pentanoic acid; 3-((bis(octyloxy) phosphorothioyl)thio)butanoic acid; 3-((bis(octyloxy) phosphorothioyl)thio)pentanoic acid; 3-((bis(nonyloxy) phosphorothioyl)thio)butanoic acid; 3-((bis(nonyloxy) phosphorothioyl)thio)pentanoic acid; 3-((bis((2-methylpentyl)oxy)phosphorothioyl)thio)butanoic acid; 3-((bis((2-methylpentyl)oxy)phosphorothioyl)thio)pentanoic acid; 3-((bis((4-methylpentan-2-yl)oxy)phosphorothioyl)thio)butanoic acid; and 3-((bis((4-methylpentan-2-yl)oxy)phosphorothioyl)thio)pentanoic acid or a tribologically acceptable salt, solvate, hydrate, or proadditive thereof.

In yet another embodiment of the method of the present invention for improving pack stability of a lubricant composition the at least one compound of Formula I is: 3-((diisobutoxyphosphorothioyl)thio)butanoic acid, having a Formula II Formula II

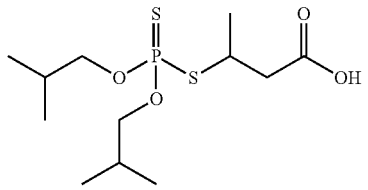

or a tribologically acceptable salt, solvate, hydrate, or proadditive thereof.

In yet another embodiment the method of the present invention for improving the pack stability of a lubricant composition comprising including in a lubricating fluid an effective amount of one or more compounds of Formula I wherein the at least one compound of Formula I is present in an amount in the range of from about 0.010 to about 4 wt % or from about 0.015 to about 1.0 wt % or from about 0.015 to about 0.5 wt % based on the weight of the lubricant composition.

In another embodiment the present invention includes a method for improving the pack stability of a lubricant composition while stored in the lubricant reservoir of a vehicle, comprising: 1) adding a lubricating fluid to a vehicle lubricant reservoir, said fluid comprising (a) a majority base oil; and (b) an effective amount of one or more compounds of Formula I:

Formula I

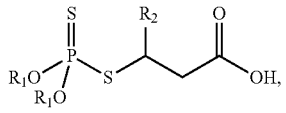

or a tribologically acceptable salt, solvate, hydrate, or proadditive thereof, wherein $R_1$ is $C_{4-9}$ alkyl or $C_{4-9}$ cycloalkyl and $R_2$ is a $C_{1-3}$ alkyl, wherein the pack stability of the lubricant composition is improved relative to the performance of a lubricating composition containing a dithiophosphate compound other than those of Formula I.

BRIEF DESCRIPTION OF THE DRAWINGS

FIG. 1. An Eyring plot of Comparative Example I providing an $r^2$=0.999.

DETAILED DESCRIPTION

The present disclosure describes highly stable compounds of Formula I. These compounds are useful as anti-wear agents in gear lubricating compositions, as well as other lubricating compositions for other machine components. The compounds of Formula I may be readily formulated with a variety of other additives, as set forth below, to achieve lubricating compositions with highly desirable stability properties, including long-lasting pack stability. It was unexpectedly discovered that alkyl substitution at the position corresponding to R2 in Formula I led to a dramatic improvement in the stability (as measured by the Pack Stability) of Formula I type dithiophosphate compounds. In some cases, stability increased four-fold over prior dithiophosphate compounds. At the same time, this increased stability of the compounds of Formula I did not reduce the wear characteristics. While not being limited by theory, it is believed that alkyl substation of the R2 position as described herein leads to a different steric environment that unexpectedly provides greater amine degradation protection. This stability may be enhanced along with the alkyl substation in the R1 position as also discussed herein.

A further aspect of the present disclosure may be directed toward a transmission lubricated with a lubricant composition comprising a compound of Formula I. Exemplary transmissions may include those described in "Transmission and Driveline Design", SAE Paper Number SP-108, Society of Automotive Engineers, Warrendale Pa. 1995; "Design of Practices: Passenger Car Automotive Transmissions", The Third Edition, SAE Publication # AE-18, Society of Automotive Engineers, Warrendale Pa. 1994; and "Automotive Transmission Advancements", SAE Paper Number SP-854, Society of Automotive Engineers, Warrendale Pa. 1991.

The present disclosure also relates to the tribologically acceptable base addition salts of Formula I. The chemical bases that may be used as reagents to prepare tribologically acceptable base salts of those compounds of Formula I that are acidic in nature are those that form base salts with such compounds. Such base salts include, but are not limited to cations such as alkali metal cations (e.g., potassium and sodium) and alkaline earth metal cations (e.g., calcium and magnesium), ammonium or amine addition salts such as N-methylglucamine-(meglumine), n-octylamine, and alkanolammonium and other base salts of tribologically acceptable organic amines.

The phrase "tribologically acceptable salt(s)", as used herein, unless otherwise indicated, includes salts of acidic or basic groups which may be present in the compounds of the present disclosure. The compounds of the present disclosure that are basic in nature are capable of forming a wide variety of salts with various inorganic and organic acids. The acids that may be used to prepare tribologically acceptable acid addition salts of such basic compounds are those that form acid addition salts, i.e., salts containing tribologically acceptable anions, such as the hydrochloride, hydrobromide, hydroiodide, nitrate, sulfate, bisulfate, phosphate, acid phosphate, isonicotinate, acetate, lactate, salicylate, citrate, acid citrate, tartrate, pantothenate, bitartrate, ascorbate, succinate, maleate, gentisinate, fumarate, gluconate, glucuronate, saccharate, formate, benzoate, glutamate, methanesulfonate, ethanesulfonate, benzenesulfonate, p-toluenesulfonate and pamoate [i.e., 1,1'-methylene-bis-(2-hydroxy-3-naphthoate)] salts. The compounds of the present disclosure that include a basic moiety, such as an amino group, may form tribologically acceptable salts with various amines, in addition to the acids mentioned above.

The present disclosure also encompasses lubricant or tribological compositions containing proadditives of compounds of the Formula I. Compounds of Formula I having free amino, amido, hydroxy or carboxylic groups can be converted into proadditives. Proadditives include compounds wherein an amino residue, carbonates, carbamates, amides, alkyl esters, etc. are covalently bonded to the substituents of Formula I but are sufficiently labile under typical lubricant use conditions that the proadditive yields a compound of Formula I.

The present disclosure also encompasses compounds of Formula I containing protective groups. One skilled in the art will also appreciate that compounds of the present disclosure can also be prepared with certain protecting groups that are useful for purification or storage and can be removed before use in the device to be lubricated. The protection and deprotection of functional groups is described in "Protective Groups in Organic Chemistry", edited by J. W. F. McOmie, Plenum Press (1973) and "Protective Groups in Organic Synthesis", 3rd edition, T. W. Greene and P. G. M. Wuts, Wiley-Interscience (1999).

The compounds of the present disclosure include all stereoisomers (e.g., cis and trans isomers) and all optical isomers of compounds of the Formula I (e.g., R and S enantiomers), as well as racemic, diastereomeric and other mixtures of such isomers.

The compounds, salts and proadditives of the present disclosure can exist in several tautomeric forms, including the enol and imine form, and the keto and enamine form and geometric isomers and mixtures thereof. All such tautomeric forms are included within the scope of the present disclosure. Even though one tautomer may be described, the present disclosure includes all tautomers of the present compounds.

As used herein, the term "alkyl," as well as the alkyl moieties of other groups referred herein (e.g., alkoxy), may be linear or branched (such as methyl, ethyl, n-propyl, isopropyl, n-butyl, iso-butyl, secondary-butyl, tertiary-butyl); optionally substituted by 1 to 3 suitable substituents as defined above such as fluoro, chloro, trifluoromethyl, $(C_1-C_6)$alkoxy, $(C_6-C_{10})$aryloxy, trifluoromethoxy, difluoromethoxy or $(C_1-C_6)$alkyl.

As used herein, the term "cycloalkyl" refers to a mono, bicyclic or tricyclic carbocyclic ring (e.g., cyclopropyl, cyclobutyl, cyclopentyl, cyclohexyl, cycloheptyl, cyclooctyl, cyclononyl, cyclopentenyl, cyclohexenyl, bicycloheptanyl, bicyclooctanyl and bicyclononanyl, etc.); optionally containing 1 or 2 double bonds and optionally substituted by 1 to 3 suitable substituents as defined above which includes but is not limited to fluoro, chloro, trifluoromethyl, $(C_1-C_6)$alkoxy, $(C_6-C_{10})$aryloxy, trifluoromethoxy, difluoromethoxy or $(C_1-C_6)$alkyl.

"Embodiment" as used herein refers to specific groupings of compounds or uses into discrete subgenera. Such subgenera may be cognizable according to one particular substituent such as a specific $R_1$ or $R_2$ group. Other subgenera are cognizable according to combinations of various substituents, such as all compounds wherein $R_2$ is hydrogen and $R_1$ is $(C_1-C_6)$alkyl.

As used herein, the terms "oil composition," "lubrication composition," "lubricating oil composition," "lubricating oil," "lubricant composition," "fully formulated lubricant composition," and "lubricant" are considered synonymous, fully interchangeable terminology referring to the finished lubrication product comprising a major amount of a base oil plus a minor amount of an additive composition. The viscosity at 100° C. for these lubricant compositions is typically between 2 and 30 cSt, or between 4 and 30 or may be between 4 and 25 or between 4 and 16 or between 4 and 12 or between 4 and 8 cSt.

As used herein, the term "base oil" refers to oils categorized by the American Petroleum Institute (API) category groups Group I-V oils as well as animal oils, vegetable oils (e.g. castor oil and lard oil), petroleum oils, mineral oils, synthetic oils, and oils derived from coal or shale. The American Petroleum Institute has categorized these different basestock types as follows: Group I, greater than 0.03 wt percent sulfur, and/or less than 90 vol percent saturates, viscosity index between 80 and 120; Group II, less than or equal to 0.03 wt percent sulfur, and greater than or equal to 90 vol percent saturates, viscosity index between 80 and 120; Group III, less than or equal to 0.03 wt percent sulfur, and greater than or equal to 90 vol percent saturates, viscosity index greater than 120; Group IV, all polyalphaolefins. Hydrotreated basestocks and catalytically dewaxed basestocks, because of their low sulfur and aromatics content, generally fall into the Group II and Group III categories. Polyalphaolefins (Group IV basestocks) are synthetic base oils prepared from various alpha olefins and are substantially free of sulfur and aromatics.

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may sometimes be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source with or without little further purification treatment. Refined oils are similar to unrefined oils except that they have been treated by one or more purification steps, which may result in the improvement of one or more properties. Examples of suitable purification techniques are solvent extraction, secondary distillation, acid or base extraction, filtration, percolation, and the like. Oils refined to the quality of an edible oil may or may not be useful. Edible oils may also be called white oils. In some embodiments, lubricant compositions are free of edible or white oils.

Re-refined oils are also known as reclaimed or reprocessed oils. These oils are obtained in a manner similar to that used to obtain refined oils using the same or similar processes. Often these oils are additionally processed by techniques directed to removal of spent additives and oil breakdown products.

Mineral oils may include oils obtained by drilling, or from plants and animals and mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully-hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In an embodiment, oils may be prepared by a Fischer-Tropsch gas-to-liquid synthetic procedure as well as from other gas-to-liquid oils.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity or the majority base oil that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

As used herein, the terms "additive package," "additive concentrate," "additive mixture," and "additive composition" are considered synonymous, fully interchangeable terminology referring the portion of the lubricating composition excluding the major amount of base oil stock mixture.

As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

Additional objects and advantages of the disclosure will be set forth in part in the description which follows, and/or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

Lubricating compositions can include compounds of Formula I, in some embodiments, in an amount in the range of from about 0.01 to about 1 wt % based on the weight of the lubricant composition. In some embodiments, lubricating compositions can contain from 0.05 to 0.5 wt %, or from about 0.01 to about 0.4 wt %, or from about 0.01 to about 0.3 wt %, or from about 0.01 to about 0.2 wt %, or from about 0.01 to about 0.015 wt %, or from about 0.025 to about 0.2 wt %, or from about 0.05 to about 0.025 wt %, or from about 0.06 to 0.25 wt %, or from about 0.07 to 0.25 wt %, or from about 0.07 to 0.14 wt %, or from about 0.07 to 0.12 wt %, based on the weight of the lubricant composition. In other embodiments the compounds of Formula I are present in an amount of between about 0.01 and about 4 wt. % or between about 0.015 and about 1.0 wt. % or between about 0.015 and about 0.5 wt. % based on the weight of the lubricant composition.

As mentioned above, the compounds of Formula I can be readily formulated into lubricating compositions suitable for a variety of machine parts and components. The lubricating compositions containing compounds of Formula I, contain a majority base oil and optionally one or more of other additive components that can make the compositions disclosed herein suitable for a variety of uses. The additive components disclosed below are not intended to be limiting, and additive components not expressly disclosed herein may also be used. Without limitation, additive components that can be used with compounds of Formula I include antioxidants, other anti-wear agents, boron-containing compounds, detergents, dispersants, extreme pressure agents, friction modifiers, molybdenum-containing components, viscosity index improvers, and combinations of the foregoing additive components.

Optional Additive Components

Antioxidants

The lubricating oil compositions herein also may optionally contain one or more antioxidants. Antioxidant compounds are known and include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidants may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight of the antioxidant, based upon the final weight of the lubricating oil composition. In some embodiments, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges of from about 0 wt. % to about 20 wt. %, or about 0.1 wt. % to about 10 wt. %, or about 1 wt. % to about 5 wt. %, of the lubricating composition.

Anti-Wear Agents

The lubricating oil compositions herein also may optionally contain one or more anti-wear agents. Examples of suitable anti-wear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. The phosphorus containing anti-wear agents are more fully described in European Patent No. 0612 839. The metal in the dialkyl dithio phosphate salts may be an alkali metal, alkaline earth metal, aluminum, lead, tin, molybdenum, manganese, nickel, copper, titanium, or zinc. A useful anti-wear agent may be a zinc dialkyldithiophosphate.

The anti-wear agent may be present in ranges of from about 0 wt. % to about 15 wt. %, or about 0.01 wt. % to about 10 wt. %, or about 0.05 wt. % to about 5 wt. %, or about 0.1 wt. % to about 3 wt. % of the total weight of the lubricating composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt. %, about 0.01 wt. % to about 7 wt. %, about 0.05 wt. % to about 5 wt. %, or about 0.1 wt. % to about 3 wt. % of the total weight of the lubricating composition.

Detergents

The lubricant composition may optionally comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds and methylene bridged phenols. Suitable detergents and their methods of preparation are described in greater detail in numerous patent publications, including U.S. Pat. No. 7,732,390, and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being one of benzyl, tolyl, and xylyl.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols.

The overbased detergent may have a metal ratio of from 1.1:1, or from 2:1, or from 4:1, or from 5:1, or from 7:1, or from 10:1.

In some embodiments, a detergent is effective at reducing or preventing rust in a gear, axle, or engine.

The detergent may be present at about 0 wt. % to about 10 wt. %, or about 0.1 wt. % to about 8 wt. %, or about 1 wt. % to about 4 wt. %, or greater than about 4 wt. % to about 8 wt. % based on the total weight of the lubricant composition.

Dispersants

The lubricant composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in a range of about 350 to about 5000, or about 500 to about 3000. Succinimide dispersants and their preparation are disclosed, for instance in U.S. Pat. No. 7,897,696 and U.S. Pat. No. 4,234,435. Succinimide dispersants are typically an imide formed from a polyamine, typically a poly(ethyleneamine).

In some embodiments the lubricant composition comprises at least one polyisobutylene succinimide dispersant derived from polyisobutylene with number average molecular weight in the range about 350 to about 5000, or about 500 to about 3000. The polyisobutylene succinimide may be used alone or in combination with other dispersants.

In some embodiments, polyisobutylene (PIB), when included, may have greater than 50 mol %, greater than 60 mol %, greater than 70 mol %, greater than 80 mol %, or greater than 90 mol % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. No. 4,152,499 and U.S. Pat. No. 5,739,355. When used in the aforementioned thermal Ene reaction, HR-PIB may lead to higher conversion rates in the reaction, as well as lower amounts of sediment formation, due to increased reactivity.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. No. 7,645,726; U.S. Pat. No. 7,214,649; and U.S. Pat. No. 8,048,831 describe some suitable post-treatment methods and post-treated products.

The dispersant, if present, can be used in an amount sufficient to provide up to about 20 wt. %, based upon the total weight of the lubricating oil composition. The amount of the dispersant that can be used may be about 0.1 wt. % to about 15 wt. %, or about 0.1 wt. % to about 10 wt. %, or about 3 wt. % to about 10 wt. %, or about 1 wt. % to about 6 wt. %, or about 7 wt. % to about 12 wt. %, based upon the total weight of the lubricating oil composition. In an embodiment, the lubricating oil composition utilizes a mixed dispersant system.

Extreme Pressure Agents

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

The lubricating oil compositions herein may also optionally contain one or more additional friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidines, alkanolamides, phosphonates, metal-containing compounds, glycerol esters, sulfurized fatty compounds and olefins, sunflower oil and other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In a embodiments the friction modifier may be a long chain fatty acid ester. In an embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may be present in amounts of about 0 wt. % to about 10 wt. %, or about 0.01 wt. % to about 8 wt. %, or about 0.1 wt. % to about 4 wt. %, based on the total weight of the lubricant composition.

Molybdenum-Containing Components

The lubricating oil compositions herein may also contain one or more molybdenum-containing compounds. An oil-soluble molybdenum compound may have the functional performance of an anti-wear agent, an antioxidant, a friction modifier, or any combination of these functions. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In an embodiment the oil-soluble molybdenum compound may be selected from the group consisting of molybdenum dithiocarbamates, molybdenum dialkyldithiophosphates, amine salts of molybdenum compounds, and mixtures thereof. In an embodiment the oil-soluble molybdenum compound may be a molybdenum dithiocarbamate.

Suitable examples of molybdenum compounds which may be used include commercial materials sold under trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710, available from Adeka Corporation, and mixtures thereof. Suitable molybdenum compounds are described in U.S. Pat. No. 5,650,381; and U.S. Reissue Pat. Nos. Re 37,363 E1; Re 38,929 E1; and Re 40,595 E1.

Additionally, the molybdenum compound may be an acidic molybdenum compound. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, or at least 25, at least 30, or at least 35 carbon atoms. Additional suitable molybdenum compounds are described in U.S. Pat. No. 6,723,685.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum in the lubricant composition.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The lubricating oil compositions herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. % based on the total weight, of the lubricating composition.

Other Optional Additives

Other additives may be selected to perform one or more functions required of a lubricating fluid. Further, one or more of the mentioned additives may be multi-functional and provide other functions in addition to or other than the function prescribed herein.

A lubricating composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, anti-wear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Respective amounts of additives may be blended into a selected base oil in amounts that may be sufficient to provide their expected performance. An effective amount for a specific formulation may be readily ascertained, but for illustrative purposes these general guides for representative effective amounts are provided. The amounts below are given in weight % of the fully formulated lubricating fluid.

| Component | Example Ranges |
|---|---|
| Dispersants | 0-20 |
| Friction Modifier(s) | 0-10 |
| Detergents | 0-5 |
| Viscosity Index Improver | 0-30 |
| Antioxidants | 0-2 |
| Rust inhibitor | 0-1 |
| Corrosion Inhibitor | 0-5 |
| Anti-wear agent | 0-5 |
| Seal Swell Agent | 0-10 |
| Antifoam Agent | 0-0.5 |
| Lubricating Base Oil | Balance |

EXAMPLE COMPOUNDS OF FORMULA I AND COMPARATIVE COMPOUNDS

The synthesis of selected compounds of Formula I and comparative compounds, as well as their characterization in a lubricating composition, is described below. Generally, the synthesis of these compounds can be accomplished by known methods in the art and as set forth below.

Compounds of Formula I

Example 1

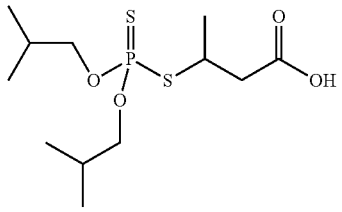

3-((diisobutoxyphosphorothioyl) thio)butanoic acid

O,O'-diisobutyl dithiophosphoric acid (775 g, 3.2 mol) was combined with crotonic acid (275 g, 3.2 mol) in a round bottomed flask equipped with a magnetic stirring bar. The contents of the flask were heated to 55° C. for 72 hours under an inert atmosphere of nitrogen to provide the material under entry 2 of Table 1.

Comparative Compounds

Comparative Example 1

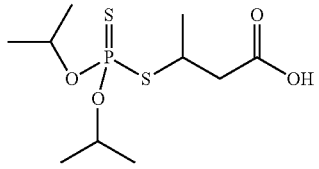

3-((diisopropoxyphosphorothioyl) thio)butanoic acid

O,O'-diisopropyl dithiophosphoric acid was reacted with crotonic acid in a manner analogous to Example 1 to generate the compound of Comparative Example 1.

Comparative Example 2

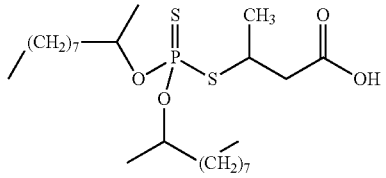

3-((bis(decan-2-yloxy)phosphorothioyl) thio)butanoic acid

O,O'-di-2-decyl dithiophosphoric acid was reacted with crotonic acid in a manner analogous to Example 1 to generate the compound of Comparative Example 2.

Comparative Example 3

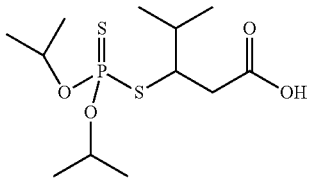

3-((diisopropoxyphosphorothioyl) thio)-4-methylpentanoic acid

4-Methylpent-2-enoic acid was prepared from isobutyraldehyde and malonic acid as described in Organic Letters, 2006, 5745. O,O'-diisopropyl dithiophosphoric acid (107 g, 0.5 mol) was combined with 4-methylpent-2-enoic acid (58.2 g, 0.51 mol) in a round bottomed flask at room temperature and then brought to 60° C. for seven days. The reaction mixture was determined by $^{31}$P NMR to contain <3% unreacted O,O'-diisobutyl dithiophosphoric acid at this time and no further purification was attempted.

Comparative Example 4

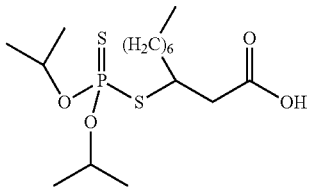

3-((diisopropoxyphosphorothioyl) thio)decanoic acid (O,O'-diisopropyl dithiophosphoric acid (74.8 g, 0.35 mol) was combined with (E)-dec-2-oic acid (60.2 g, 0.35 mol) and acetonitrile (80 mL) in a round bottomed flask at room temperature and then brought to 60° C. for 48 hrs. The reaction contents were concentrated under reduced pressure to remove acetonitrile.

Comparative Example 5

Reference Compound

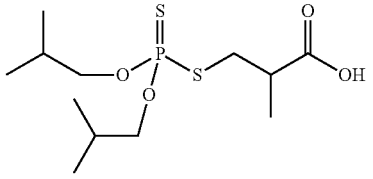

3-((diisobutoxyphosphorothioyl) thio)-2-methylpropanoic acid 3-((diisobutoxyphosphorothioyl)thio)-2-methylpropanoic acid is commercially available from BASF (formerly Ciba Geigy) and marketed under the trademark IRGALUBE 353.

Testing

The compounds of Formula I and the comparative compounds, including the reference compound, in the above examples were formulated into lubricating compositions and subjected to various testing regimes to assess their performance as anti-wear agents and to determine their influence on lubricant stability. The tests included FZG Verschleiss testing, 4-ball wear scar testing, and pack stability testing. The testing methodologies and parameters used are set forth below. Each described test was performed with the same formulation only the choice of anti-wear was changed. Each of the anti-wear was delivered into the formulation on an equal phosphorus basis.

EOT Fe Determination (FZG Verschleiss Test)

The low speed FZG Verschleiss test was used to determine the end of test iron content (EOT Fe), which represents the amount of metal gear material lost from the gear as a result of wear. New standard FZG C pitting gears were used for each test. The gears had a tooth thickness of 14 mm, a center distance of 91.5 mm and a roughness of 0.3+1-0.1 μm. The testing procedure utilized three 40 hour cycles to determine gear wear. Each cycle had a pinion speed of 13 rpm and a pressure of 1814 N/mm$^2$. Cycles 1 and 3 were conducted at 90° C., and cycle 2 was conducted at 120° C. Gears were weighed prior to the test to the nearest milligram. Gears were subsequently weighed after each cycle, cleaned sequentially with Stoddard solvent, acetone, and pentane, and then placed in a desiccator for 1 hour to stabilize. Each gear was thus weighed three times. The cleaning cycle was repeated until 2 consecutive weightings were the same. The finished fluids used in the FZG Verschleiss test contained Inventive Example I and Comparative Exs. 1-5 at equal phosphorus concentrations. The base lubricant was identical and contained 0.005 wt. % pour point depressant, nonylated diphenylamine at 0.3 wt. %, Na-Sul® 729 at 0.3 wt. %, Irgamet 39 at 0.06 wt. %, succinimide dispersant at 0.5 wt. %, metal detergent at 3.0 wt. %, a succinimide friction modifier at 0.2 wt. %, polymethacrylate viscosity index improver at 5.6 wt. %, and the balance Group III mineral oil. The finished lubricant composition had an overall kinematic viscosity of approximately 10 cSt at 100° C.

4-Ball Wear Scar Determination

The fluids used for the 4-ball wear scar determination were comprised of 6% viscosity index improver, 18% 600N base oil and 76% 150N base oil. This fluid was then top treated with 1260 ppm phosphorus delivered from the compounds of Inventive Example 1 and Comparative Exs. 1-5. The kinematic viscosity of these finished lubricant compositions was approximately 7.5 cSt at 100° C. The conditions of the 4-ball wear scar determination were in accordance with ASTM method D4172 (1200 rpm, 40 KG, 75° C., 1 hr).

Pack Stability Parameter (Eq. 1)

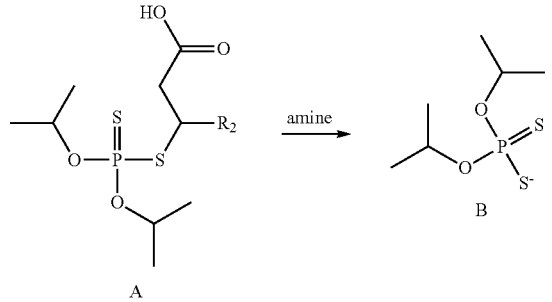

The Pack Stability tests described herein are an adaptation to that reported by R. Wolfenden in *Chem. Rev.* 2006, 106, 3379-3396. Typical lubricant compositions requiring anti-wear control contain amines in the form of dispersants, friction modifiers, etc. These amines tend to degrade the composition of the phosphorus anti-wear components and in particular dithiophosphate anti-wear chemistry. In order to measure the resistance of lubricant compositions containing various dithiophosphate compounds to amine degradation a Pack Stability Parameter test was devised to provide a relative ranking of the lubricant compositions.

Eq. 1 shows the scheme for the degradation of a generic O,O-dialkyl S-alkyl phosphorodithioate compound, compound A, into compound B when exposed to amine in a lubricant composition. This degradation pathway is undesirable and typically occurs during storage of a concentrated additive package or finished lubricant containing the phosphorodithioate. The rate of this degradation reaction was measured at a variety of temperatures for the compounds of Inventive Example 1 and Comparative Exs. 1-5 to determine the Eyring equation for their respective reactions.

For example, Comparative Ex. 1 displays a $^{31}$P NMR signal ($C_6D_6$, 161.99 MHz) at 90.3 ppm. Treating this material in 150SN88VI process oil with octylamine lead to the observation of a new peak in the $^{31}$P NMR spectrum at 108.9 ppm corresponding to anionic O,O'-diisopropyl dithiophosphate, equivalent to Compound B in Equation 1 above. The relative intensity of the two signals in the $^{31}$P NMR spectrum can be used to gauge the extent of reaction. The extent of reaction is determined by the ratio:

$$\frac{I_A}{I_A + I_B} \quad \text{(Eq. 2)}$$

In Eq. 2, $I_A$ and $I_B$ represent the NMR signal intensity arising from Comparative Ex. 1, representing compound A in Equation 1 above, and anionic O,O'-diisopropyl dithiophosphate, representing compound B, respectively.

An observed rate constant can then be calculated using the equation:

$$k=[\ln(\text{extent of reaction})]/\text{time} \quad \text{(Eq. 3)}$$

provided that pseudo-first order conditions are met.

Pseudo-first order reaction conditions can be met with an amine concentration at least ten-fold greater than the concentration of compound A so that the amine concentration does not change appreciably over the course of the test. The Pack Stability Parameter numbers in Table 1 were generated by introducing the compounds of Inventive Example 1 and Comparative Exs. 1-5 at an initial concentration of 0.05 M to octylamine at a concentration of 0.5 M. Rate constants, k, were determined at a series of temperatures and the data plotted as in FIG. 1.

Linear regression of the data generated for Comparative Example I gave the Eyring equation $\ln(k/T)=(-7.4\pm0.2)\times10^3/T+(2.5\pm0.6)$; $r^2=0.999$, where T is the temperature in Kelvin. This equation can be used to calculate a rate constant that describes the decomposition process at any temperature and therefore the extent of reaction can be calculated for any given condition of temperature and time. The Pack Stability Parameter listed in Table 1 was calculated by taking the rate constant for the reference compound, Comparative Example 5, at 293K and dividing by the rate constant of the other compounds, Inventive Ex. 1 and Comparative Exs. 1-4 at 293K. Thus, the Pack Stability Parameter$=k^{ref}/k^X$, where $k^{ref}$ is the rate constant measured for the Reference Compound, Comparative Ex. 5, and $k^X$ is the rate constant for Inventive Ex. 1 and Comparative Exs. 1-4. The Pack Stability Parameter is therefore normalized to the Reference Compound, where $k^{ref}/k^x=1$ for the Reference Compound.

Pack Stability Time

The methods used to determine the Pack Stability Parameter can also be used to express the Pack Stability Time which is the time required to thermally degrade 10% of the O,O-dialkyl S-alkyl phosphorodithioate compounds when exposed to octylamine at 20° C. The time to 10% decomposition is obtained by rearranging Eq. 3 to:

$$\text{Time}=[\ln(\text{extent of reaction})]/k \quad \text{(Eq. 4)}$$

and setting the term "extent of reaction" to 0.9. In Table I Pack Stability Time is reported in days.

In addition to the Pack Stability Parameter and Pack Stability Time measurements, the Reference Compound and the Inventive and Comparative examples were subjected to well-known and accepted wear tests as detailed below.

Increased Stability of Lubricating Compositions Containing Compounds of Formula I Lubricant compositions comprising compounds described in Inventive and Comparative Examples above were subjected to stability testing. To assess the performance and stability characteristics of compounds of Formula I, selected compounds of Formula I (IE 1 in Table 1) were compared against a reference compound previously reported in U.S. Pat. No. 5,922,657 (CE 5, Table 1) and against comparative compounds that are structurally related to compounds of Formula I (CE 1-4, Table 1). The results of the tests are summarized in Table 1 below. The base lubricant was different for each test and is further described in the test descriptions above. However, for each individual test in Table 1, the Example compounds were used at equal phosphorus concentrations and in the same base formulation. Accordingly, the performance differences are due to differences in the selection of the dithiophosphate and the various substitutions at $R_1$, $R_2$ and $R_3$.

TABLE 1

Anti-wear compounds and relevant performance testing and stability parameters.

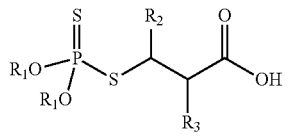

| Example | $R_1$ | $R_2$ | $R_3$ | 4-Ball WS, mm | FZG Verschleiss test (EOT Fe in mg) | Pack Stability Parameter[a] | Pack Stability Time (days) |
|---|---|---|---|---|---|---|---|
| CE 5* | $—CH_2CH(CH_3)_2$ | H | $CH_3$ | 0.372 | 33 | 1 | 154 |
| IE 1 | $—CH_2CH(CH_3)_2$ | $CH_3$ | H | 0.385 | 38 | 4 | 660 |
| CE 1 | $—CH(CH_3)_2$ | $CH_3$ | H | 0.402 | 34 | 0.2 | 33 |
| CE 2 | 2-decyl | $CH_3$ | H | 0.265 | 130 | — | — |
| CE 3 | $—CH(CH_3)_2$ | $—CH(CH_3)_2$ | H | 0.487 | — | 0.01 | 0.17 |
| CE 4 | $—CH(CH_3)_2$ | n-heptyl | H | 0.556 | — | 0.0009 | 0.17 |

[a]Pack Stability Parameter values are normalized to the Reference Compound
*Reference Compound CE 5 in Table 1, which was disclosed in U.S. Pat. No. 5,922,657, has been used as a reference compound. IE 1 in Table 1 is a representative compound of Formula I. CE 1-4 in Table 1 are comparative compounds.

The results of the 4-ball wear test and the FZG Verschleiss test show that metal parts lubricated with lubricant containing a compound of Formula I (IE 1, Table 1) has wear properties similar to those for the Reference Compound while having significantly improved Pack Stability.

The results set forth in Table 1 illustrate the surprising stability of the compounds according to Formula I. It was unexpectedly discovered that alkyl substitution at the position corresponding to $R_2$ led to a four-fold improvement in the stability (as measured by the Pack Stability) of Formula I type dithiophosphate compounds relative to the reference compound. IE 1 showed a Pack Stability of 660 days compared to only 154 days for the Reference Compound. Without being bound by theory, it is believed that alkyl substitution of the $R_2$ position leads to a different steric environment that unexpectedly provides greater amine degradation protection.

Moreover and also surprisingly, comparative compounds, CE 1-4 in Table 1, while structurally similar to compounds of Formula I, did not exhibit the same pack stability as the compounds of Formula I. For example, CE 1, which differs from IE 1 by only a single carbon in the $R_1$ group, was a factor of twenty less Pack Stable. The increased stability of the compounds of Formula I do not impact their wear characteristics. In fact, as seen by the test results, IE 1 performed well in wear tests, as demonstrated by the results of the FZG Verschleiss test and 4 ball wear scar tests when compared to the wear characteristics of the Reference and comparative compounds.

It will be appreciated that the individual components employed may be separately blended into the base fluid or may be blended therein in various sub-combinations, if desired. Ordinarily, the particular sequence of such blending steps is not crucial. Moreover, such components may be blended in the form of separate solutions in a diluent. It may be preferable, however, to blend the additive components used in the form of a concentrate, as this simplifies the blending operations, reduces the likelihood of blending errors, and takes advantage of the compatibility and solubility characteristics afforded by the overall concentrate.

Additive concentrates may thus be formulated to contain all of the additive components and if desired, some of the base oil component, in amounts proportioned to yield finished fluid blends consistent with the concentrations described above. In most cases, the additive concentrate will contain one or more diluents such as light mineral oils, to facilitate handling and blending of the concentrate. Thus concentrates containing up to about 50 wt. % of one or more diluents or solvents may be used, provided the solvents are not present in amounts that interfere with the low and high temperature and flash point characteristics and the performance of the finished power transmission fluid composition. In this regard, the additive components used pursuant to this disclosure may be selected and proportioned such that an additive concentrate or package formulated from such components will have a flash point of about 170° C. or above, using the ASTM D-92 test procedure.

Lubricating fluids of the embodiments herein may be formulated to provide lubrication and/or enhanced friction performance properties and/or improved pack stability properties for various applications. A lubricant composition including a compound of Formula I, or a tribologically acceptable salt or solvate thereof, may be used for lubricating a machine part, such as a gear. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears.

Lubricating compositions disclosed herein are can also be suitable for automatic or manual transmissions, including step automatic transmissions, continuously variable transmissions, semi-automatic transmissions, automated manual transmissions, toroidal transmissions, and dual clutch transmissions. The presently disclosed lubricating compositions can also be used in axles, transfer cases, differentials, such as straight differentials, turning differentials, limited slip differentials, clutch-type differentials, and locking differentials, and the like.

Lubricating fluids of the present disclosure can be used in various engine applications, including but not limited to, internal combustion engines, rotary engines, gas turbine engines, four-stroke engines, and two-stroke engines. Engine components that may be lubricated with presently disclosed additives may include pistons, bearings, crankshafts, and/or camshafts. Further, they may also be useful in metalworking applications. A further aspect of the present disclosure may provide lubricant composition comprising a lubricant additive as described herein, wherein the lubricant composition is suitable for lubricating moving components or parts of a truck, an automobile, and/or a piece of mechanized farm equipment, such as a tractor or reaper.

It is understood that lubricant compositions and/or lubricant additives according to an embodiment of the present disclosure may further exhibit sufficient durability in friction performance.

At numerous places throughout this specification, reference has been made to a number of U.S. patents, European Patent Applications (published), PCT International patent publications, and literature references. All such cited documents are expressly incorporated in full into this disclosure as if fully set forth herein.

While the present disclosure has been principally demonstrated hereinabove in the examples as a gear lubrication additive, it is contemplated that the benefits of the lubricating compositions disclosed herein are similarly applicable to other lubricating or power transmitting fluids. Included within the scope of the present disclosure may be, but not limited to, gear oils, hydraulic fluids, engine oils, heavy duty hydraulic fluids, industrial oils, power steering fluids, pump oils, tractor fluids, and universal tractor fluids. Apparatus embodiments may include, but are not limited to, gears, engines, hydraulic mechanisms, power steering devices, pumps and the like incorporating a lubricating composition according to the present disclosure.

Other embodiments of the present disclosure will be apparent to those skilled in the art from consideration of the specification and practice of the embodiments disclosed and suggested herein. It is intended that the specification and examples be considered as exemplary only, with a true scope and spirit of the disclosure being indicated by the following claims.

What is claimed is:

1. A compound of Formula I:

Formula I

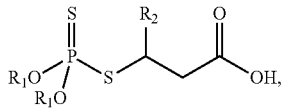

or a tribologically acceptable salt, solvate, hydrate, or proadditive thereof, wherein $R_1$ is $C_{4-5}$ alkyl; and wherein $R_2$ is methyl.

2. A compound according to claim 1 selected from the group consisting of:

3-((diisobutoxyphosphorothioyl)thio)butanoic acid;

3-((dibutoxyphosphorothioyl)thio)butanoic acid; and 3-((bis(pentyloxy)phosphorothioyl)thio)butanoic acid.

3. A compound according to claim 1 wherein the compound is:

3-((diisobutoxyphosphorothioyl)thio)butanoic acid, of Formula II:

Formula II

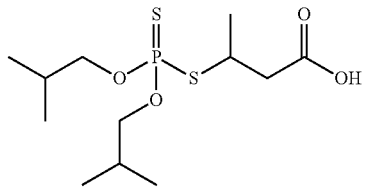

or a tribologically acceptable salt, solvate, hydrate, or proadditive thereof.

4. A lubricant composition comprising:

a) a majority base oil; and b) at least one compound of Formula I:

Formula I

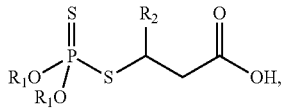

or a tribologically acceptable salt, solvate, hydrate, or proadditive thereof, wherein $R_1$ is $C_{4-5}$ alkyl; and wherein $R_2$ is methyl.

5. The lubricant composition of claim 4, wherein the at least one compound of Formula I is selected from the group consisting of:

3-((diisobutoxyphosphorothioyl)thio)butanoic acid;

3-((dibutoxyphosphorothioyl)thio)butanoic acid; and 3-((bis(pentyloxy)phosphorothioyl)thio)butanoic acid.

6. The lubricant composition of claim 4, wherein the at least one compound of Formula I is: 3-((diisobutoxyphosphorothioyl)thio)butanoic acid, of Formula II:

Formula II

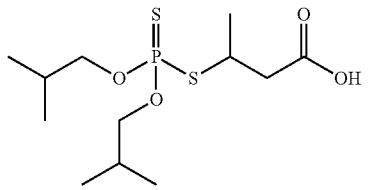

or a tribologically acceptable salt, solvate, hydrate, or proadditive thereof.

7. The lubricant composition of claim 4, further comprising an oil-soluble ashless dispersant selected from the group consisting of: a succinimide dispersant, a succinic ester dispersant, a succininic ester-amide dispersant, a Mannich base dispersant, phosphorylated forms thereof, and boronated forms thereof.

8. The lubricant composition of claim 4, further comprising an additive composition comprising at least one component selected from the group consisting of an air expulsion additive, an antioxidant, a corrosion inhibitor, a foam inhibitor, a metallic detergent, a seal-swell agent, a viscosity index improver, and an extreme pressure additive.

9. The lubricant composition of claim 4, wherein the at least one compound of Formula I is present in an amount in the range of from about 0.010 to about 4 wt % based on the weight of the lubricant composition.

* * * * *